US005732566A

United States Patent [19]

Choi

[11] Patent Number: 5,732,566

[45] Date of Patent: Mar. 31, 1998

[54] HEAT PUMP WITH MOVEABLE PARTITION VALVE

[75] Inventor: Dong Kyoo Choi, Kyungki-Do, Rep. of Korea

[73] Assignee: Samsung Electronics Co., Ltd., Suwon, Rep. of Korea

[21] Appl. No.: 735,611

[22] Filed: Oct. 23, 1996

[30] Foreign Application Priority Data

Nov. 4, 1995 [KR] Rep. of Korea ..... 95-32628

[51] Int. Cl.[6] ..... F25B 13/00

[52] U.S. Cl. ..... 62/324.6; 62/511

[58] Field of Search ..... 62/324.1, 324.6, 62/498, 504, 511, 528

[56] References Cited

U.S. PATENT DOCUMENTS 4,263,787 4/1981 Domingorena ..... 62/324.6

5,029,454 7/1991 Eisberg ..... 62/324.6

*Primary Examiner*—John M. Sollecito

*Attorney, Agent, or Firm*—Burns, Doane, Swecker & Mathis, L.L.P.

[57] ABSTRACT

A heat pump heating and cooling system includes a compressor, indoor and outdoor heat exchangers, and two expansion devices. Interposed between the expansion devices is a cut-off device which permits refrigerant to flow between the indoor and outdoor heat exchanges while the compressor is operating, and blocks such flow while the compressor is idle, thereby isolating high and low pressure fluids from one another while the compressor is idle.

6 Claims, 4 Drawing Sheets

HEAT PUMP WITH MOVEABLE PARTITION VALVE

FIELD OF THE INVENTION

The present invention relates generally to an air conditioning system.

BACKGROUND OF THE INVENTION

FIGS. 4A and 4B are system diagrams of a conventional heat pump heating and cooling system. FIG. 4A shows circulation of refrigerant when the heat pump system operates in the cooling cycle, and FIG. 4B illustrates circulation of refrigerant during the heating cycle.

A conventional heat pump heating and cooling system capable of alternately accomplishing the processes of room-heating and room-cooling includes a compressor 1 which compresses refrigerant to a high temperature and pressure, outdoor and indoor heat exchangers 2 and 3 which allow the refrigerant to exchange heat with indoor air and outdoor air, respectively, and two expansion tubes 4 and 5 that serve to expand the refrigerant to a low temperature and pressure.

The conventional heat pump heating and cooling system also includes a four-way valve 6 which changes a stream of refrigerant's direction so as to let the system alternately operate in the cooling and heating cycles, and a check valve 7 which restricts the refrigerant's circulation to one direction within the system.

The above-mentioned components of the heat pump heating and cooling system are interconnected by refrigerant pipes. In other words, the compressor 1, the four-way valve 6, the outdoor heat exchanger 2, the first expansion tube 4, the second expansion tube 5, and the indoor heat exchanger 3 are interconnected in sequence by the refrigerant pipes, constituting a closed refrigerant circuit. The check valve 7 is interposed between the first expansion tube 4 and the indoor heat exchanger 3, and parallel with the second expansion tube 5.

When such a heat pump heating and cooling system operates in the cooling cycle, the refrigerant is circulated in the direction of the arrows of FIG. 4A. First, refrigerant vapor which is compressed to a high temperature and pressure and is then pumped out by the compressor 1 into the outdoor heat exchanger 2, which serves as a condenser, by way of the four-way valve 6. Heat is transferred to outdoor air from the compressor 1; thereby the refrigerant liquid condenses into the liquid phase.

Next, the liquid refrigerant is expanded to a low temperature and pressure as it passes through the first expansion tube 4 and the check valve 7, and then enters the indoor heat exchanger 3, which serves as an evaporator. The refrigerant does not pass through the second expansion tube 5 because the path through the check valve 7 exerts relatively little fluid resistance.

The refrigerant then enters the indoor heat exchanger 3 where it captures heat from indoor air, thereby returning to a gaseous state. Lastly, the refrigerant vapor flows into the compressor 1 after passing through the four-way valve 6, and continuously repeats the above process, cooling the room.

FIG. 4B depicts the stream of refrigerant during the heating cycle. Refrigerant vapor compressed to a high temperature and pressure and jetted out by the compressor 1 is forced to enter the indoor heat exchanger 3, functioning as a condenser, through the four-way valve 6. Heat is transferred from the refrigerant in the indoor heat exchanger 3 to indoor air, thereby causing the refrigerant to condense into liquid state. Since the refrigerant in the liquid state is prevented from flowing in the reverse direction by the check valve 7, it passes through the second and first expansion tubes 5 and 4 where it expands to a low temperature and pressure.

The refrigerant is then forced into the outdoor heat exchanger 2, which serves as an evaporator. The refrigerant captures heat from outdoor air as it passes through the outdoor heat exchanger 2, changing into a gaseous state. Lastly, the refrigerant vapor flows into the compressor 1 through the four-way valve 6, and heats the room by the continuous repetition of the above-mentioned process.

The refrigerant is expanded to a low temperature and low pressure after passing through the first expansion valve 4 only during the cooling cycle, while it passes through the second expansion tube 5 and the first one 4 in sequence during the heating cycle. This is because the heating cycle entails a larger degree of depressurization compared to that of the cooling cycle. Accordingly, the check valve 7 is indispensable to the conventional heat pump heating and cooling system.

In the case that the conventional heat pump heating and cooling system operates in the cooling cycle, the zone from the outlet of the compressor 1 to the inlet of the outdoor heat exchanger 2 is maintained at high pressures (hereinafter referred to as the cycle high pressure locality), and the other zone from the inlet of the indoor heat exchanger 3 to the inlet of the compressor 1 is kept at low pressures (hereafter referred to as the low pressure locality).

The high pressure locality communicates with the low pressure locality through the first and second expansion tubes 4 and 5. If the compressor 1, which is in controlled operation according to a temperature setting, temporarily enters an idle state, the refrigerant in the high pressure locality is mixed with that of the low pressure locality, equalizing refrigerant pressure and temperature throughout the system. Simply put, the refrigerant of the low pressure locality increases in pressure and temperature, and the refrigerant of the high pressure locality decreases in pressure and temperature.

When the compressor 1 is returned to operation at this point, the refrigerant of the high and low pressure localities must be returned to their previous states of pressure and temperature. This additional task raises the working hours of the compressor 1, entailing an increase in power consumption. It also impairs the effectiveness of the normal heat exchange of the refrigerant, deteriorating the cooling and heating effects of the heat pump system.

When the heat pump heating and cooling system operates in the heating cycle, the high and low pressure localities of the cooling cycle are respectively switched into low and high pressure localities in the heating cycle, and the above disadvantages created during the cooling cycle are also present. Based on the foregoing, it can be appreciated that there exists a need in the art for a heat pump heating and cooling system which overcomes the above-described disadvantages and shortcomings of presently available systems. The present invention fulfills this need.

SUMMARY OF THE INVENTION

It is an object of the present invention to provide a heat pump heating and cooling system that is designed to prevent refrigerant of the high pressure locality from being mixed with that of the low pressure locality during its idle or sleep mode of operation, thereby reducing working hours of its compressor and ensure energy efficiency.

It is another object of the present invention to provide a heat pump heating and cooling system which is of simple circuit design and construction without the check valve necessary for the conventional art.

In order to realize the above objects of the present invention, the inventive heat pump heating and cooling system includes a compressor, an indoor heat exchanger, an outdoor heat exchanger, two expansion tubes, a four-way valve, and a refrigerant cut-off means, which directs the stream of a refrigerant during the operation of the compressor and prevents the refrigerant of the high pressure locality from being mixed with that of the low pressure locality.

The refrigerant cut-off means, which is disposed between the first and second expansion tubes, includes a housing, a movable partition dividing the interior of the housing into two compartments, and an elastic member provided to each compartment so as to exert an elastic force on the movable partition with respect to each other.

The heat pump heating and cooling system also includes a first connecting tube interposed between the outdoor heat exchanger and the area of the housing forming the first compartment, a first branch tube that is diverged from the first connecting tube and is also coupled with the area of the housing forming the first compartment, a second connecting tube interposed between the indoor heat exchanger and the area of the housing forming the second compartment, and a second branch tube which is diverged from the second connecting tube and also coupled with the area of the housing forming the second compartment. The first and second expansion tubes are respectively provided to the first and second branch tubes.

BRIEF DESCRIPTION OF THE DRAWINGS

FIGS. 4A and 4B are each system diagrams of a conventional heat pump heating and cooling system, in which FIG. 4A depicts circulation of refrigerant in the case where the heat pump system operates in the cooling cycle and FIG. 4B illustrates circulation of refrigerant during the heating cycle.

DETAILED DESCRIPTION OF PREFERRED EMBODIMENTS

Figure 1:
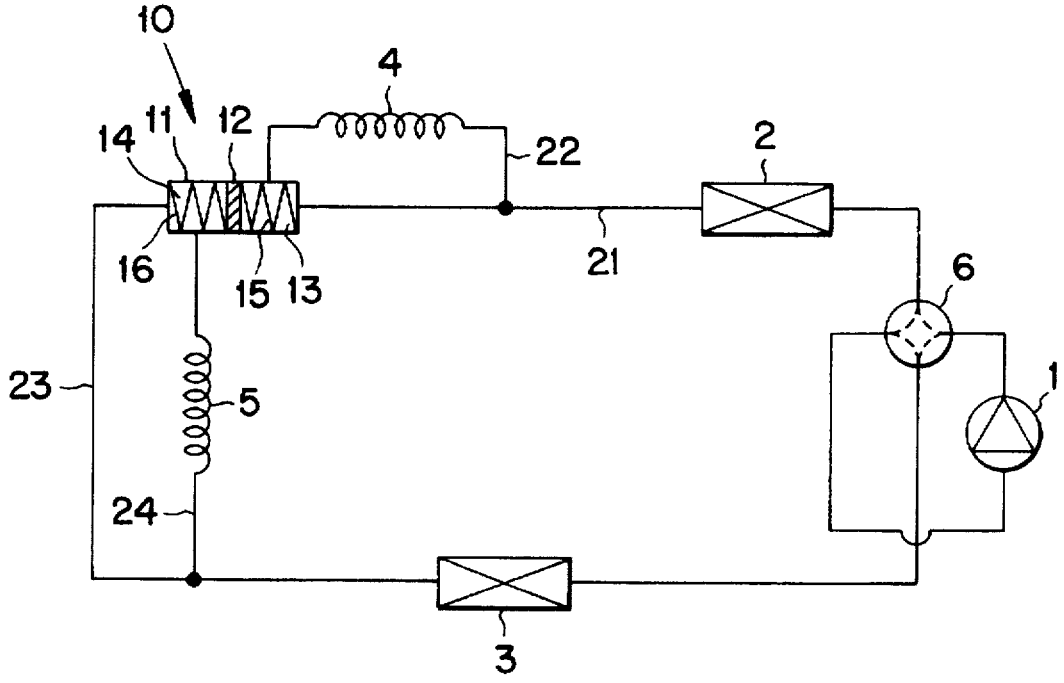
FIG. 1 shows a system diagram of a heat pump heating and cooling system in accordance with the present invention.

With reference to FIGS. 1 through 3, a preferred embodiment of the present invention will now be described. Like reference numerals designate like structural elements throughout the specification and the drawings.

FIG. 1 is a system diagram of a heat pump heating and cooling system in accordance with the present invention. The inventive heat pump heating and cooling system includes a compressor 1, an outdoor heat exchanger 2, an indoor heat exchanger, a first expansion tube 4, a second expansion tube 5, a four-way valve 6, and a refrigerant cut-off means 10 (which is one of the features of the present invention).

The refrigerant cut-off means 10 consists of a housing 11 which is in cylindrical shape, a movable partition 12 that divides the interior of the housing 11, first and second compartments 13 and 14 formed with the movable partition 12 between them, and first and second elastic members 15 and 16 respectively provided in the first and second compartments 13 and 14 to exert an elastic force on the movable partition 12.

One end of the first compartment 13 is coupled with the first connecting tube 21 which connects the refrigerant cut-off means 10 with the outdoor heat exchanger 2. Likewise, the second compartment 14 is coupled to a second connecting tube 23 which connects the refrigerant cut-off means 10 with the indoor heat exchanger 3.

The four-way valve 6 is connected to the outlet of the compressor 1, and controls the stream of refrigerant pumped out by the compressor 1 so as to supply the refrigerant to either the outdoor heat exchanger 2 or the indoor heat exchanger 3. The first branch tube 22 is diverged from the first connecting tube 21, and is then connected to the first compartment 13. The second branch tube 24 is diverged from the second connecting tube 23 to be joined with the second compartment 14.

The first and second expansion tubes 4 and 5 are respectively positioned on the first and second branch tubes 22 and 24. The movable partition 12 is interposed between junctions of the first and second branch tubes 22 and 24, and is held in place by the first and second elastic members 15 and 16.

Figure 2A:
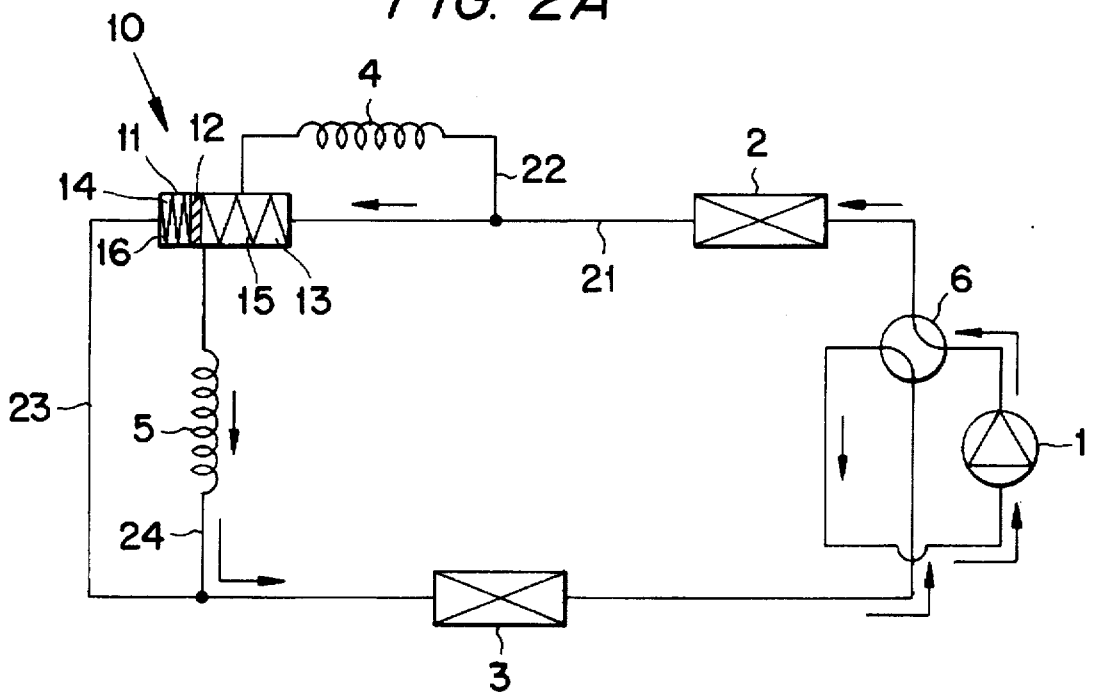
FIG. 2A illustrates normal circulation of refrigerant when the heat pump heating and cooling system of FIG. 1 operates in the cooling cycle.

FIG. 2A illustrates normal circulation of refrigerant when the heat pump heating and cooling system of FIG. 1 operates in the cooling cycle. As indicated by the arrows, when the compressor 1 goes into action during the cooling cycle, refrigerant compressed to a high temperature and pressure is forced to enter the outdoor heat exchanger 2, which serves as a condenser, by way of the four-way valve 6. In the outdoor heat exchanger 2, this refrigerant transfers heat to outdoor air and thereby condenses into a liquid form. It then is forced into the first compartment 13 of the refrigerant cut-off means 10 through the first connecting tube 21.

The refrigerant does not flow into the first branch tube 22 in which the first expansion tube 4 lies because the first expansion tube 4 applies large fluid resistance to the refrigerant. When the pressure of the refrigerant flowing into the first compartment 13 exceeds the elastic forces of the first and second elastic members 15 and 16, the first elastic member 15 expands and the second elastic member 16 compresses, thereby sliding the movable partition 12 towards the second compartment 14. Accordingly, the first compartment 13 expands to include the outlet to the second branch tube 24, and the refrigerant expands to a low temperature and pressure as it passes through the second branch tube 24 and the second expansion tube 5. The expanded refrigerant is next introduced to the indoor heat exchanger 3, which serves as an evaporator, and expands to a gaseous state as it captures heat from indoor air. The gaseous refrigerant is forced to enter the compressor 1 through the four-way valve 6 for recirculation.

Figure 2B:
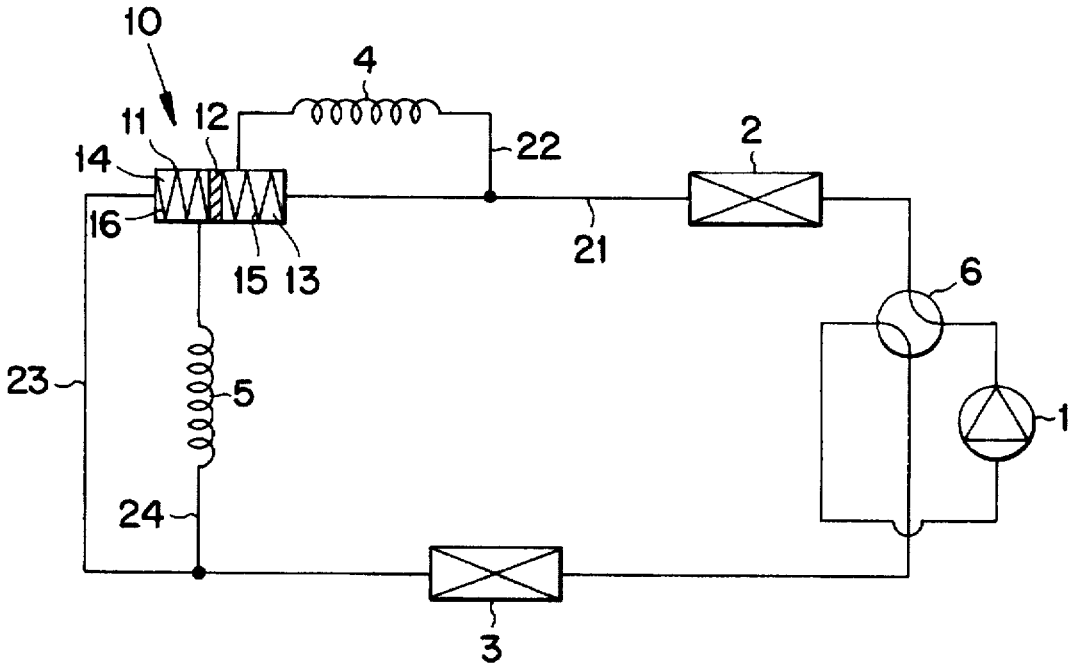
FIG. 2B is a system diagram depicting the operation of a refrigerant cut-off means installed in the heat pump heating and cooling system of FIG. 1 in the case where its compressor is in an idle state of operation following a cooling operation.

Following the repetition of the above process, the indoor ambient temperature can fall below a prescribed point; this event causes the compressor to temporarily enter an idle state. FIG. 2B illustrates the operation during this event.

Once the compressor 1 stops, refrigerant pressure in the high pressure locality decreases, and the movable partition 12 slides towards the first compartment 13 by elastic force. After the movable partition 12 passes the junction of the refrigerant cut-off means 10 and the second branch tube 24, the flow of the refrigerant through the second branch tube 24 is blocked from mixing with that of a low pressure locality. At this time the movable partition 12 is disposed at a location within the refrigerant cut-off means where the elastic forces of the first and second elastic members 15 and 16 and the pressure of the refrigerant are balanced. During compressor 1 non-operation, this location is slightly off-center toward the second compartment.

When the compressor 1 resumes operation while the refrigerant in the high pressure locality and that in the low pressure locality are being kept at high temperatures and pressures and at low temperatures and pressures, respectively, the system reenters normal cooling operation immediately.

Figure 3A:
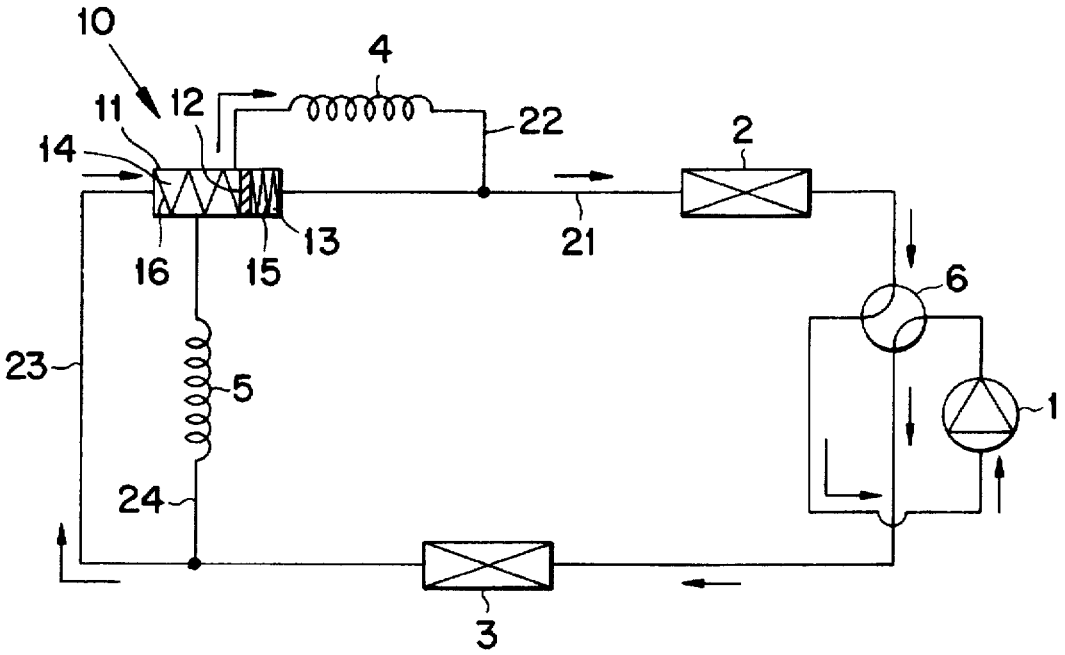
FIG. 3A illustrates normal circulation of refrigerant in case that the heat pump heating and cooling system of FIG. 1 operates in the heating cycle.

FIG. 3A illustrates normal circulation of refrigerant in case that the heat pump heating and cooling system operates in the heating cycle.

As indicated by the arrows therein, the stream of the refrigerant is changed by the four-way valve 6 so that the refrigerant is circulated in a direction opposite that of the cooling cycle. The refrigerant, compressed to a high temperature and pressure by the compressor 1, is introduced to the indoor heat exchanger 2, serving as a condenser, through the four-way valve 6. The refrigerant condenses into liquid form as it transfers heat to indoor air in the indoor heat exchanger 2, and then flows into the second compartment 14 of the refrigerant cut-off means 10 through the second connecting tube 23. The movable partition 12 is slid toward the first compartment 13 by the pressure of the refrigerant flowing into the second compartment 14, causing the outlet to the first branch tube 22 to be included in the second compartment 14. The refrigerant is expanded to a low temperature and pressure as it passes through the first branch tube 22 and the first expansion tube 4. The expanded refrigerant is next forced into the outdoor heat exchanger 2, serving as an evaporator, and is charged to a gaseous state as it exchanges heat with the outdoor air. Finally the gaseous refrigerant flows into the compressor 1 through the four-way valve 6 for recirculation.

Larger depressurization of refrigerant is necessary for the heating cycle compared to that of the cooling cycle, and, preferably, the fluid resistance of the first expansion tube 4 is larger than that of the second expansion tube 5.

Figure 3B:
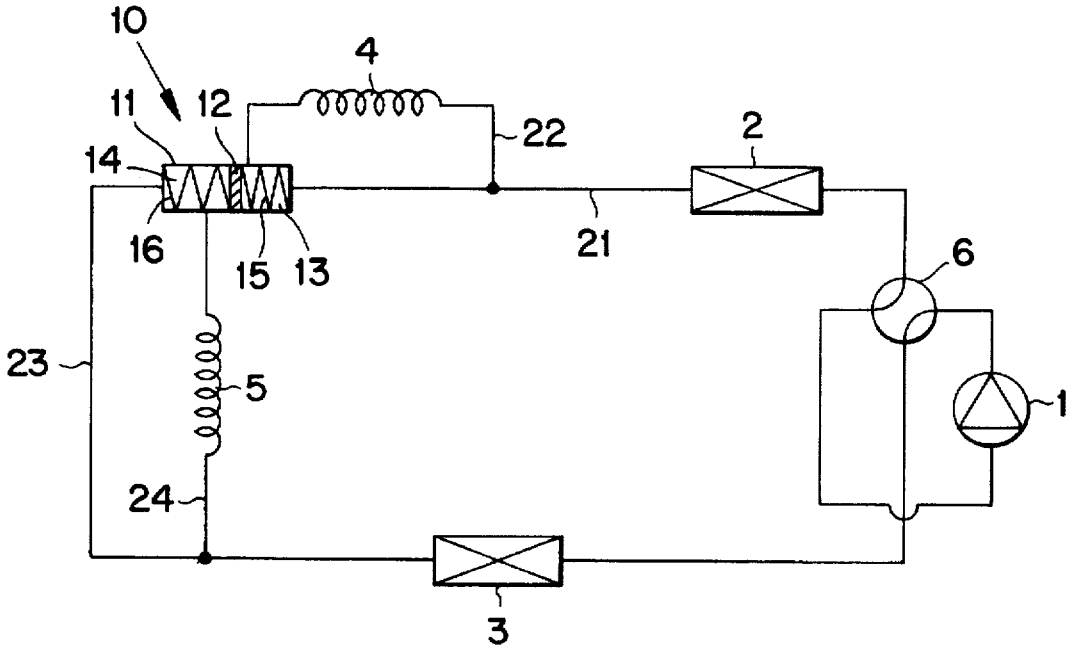
FIG. 3B is a system diagram depicting the operation of a refrigerant cut-off means installed in the heat pump heating and cooling system of FIG. 1 when its compressor is in an idle state following a cooling operation.
Figure 4A:
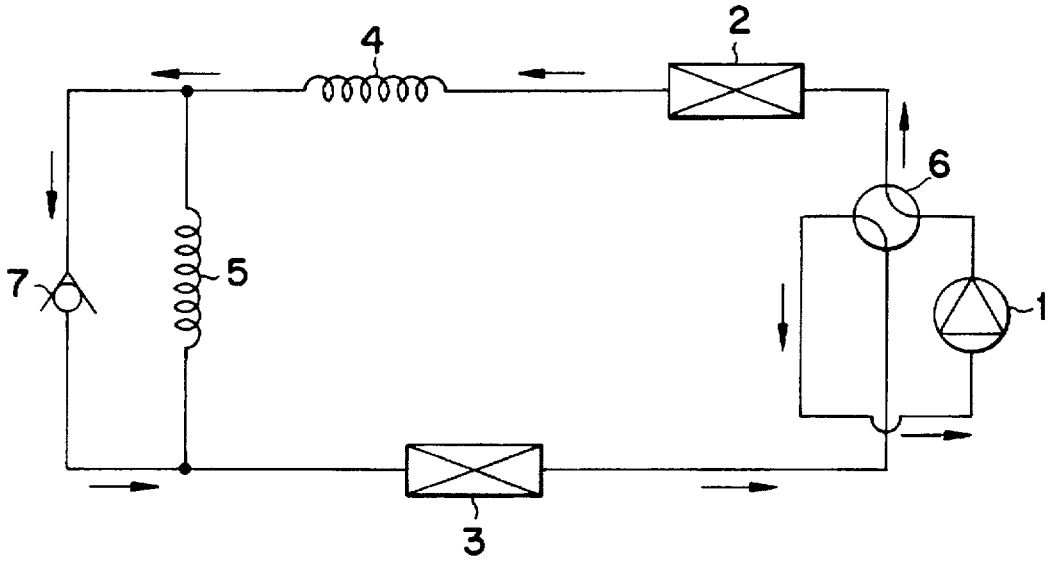
FIG. 4A (PRIOR ART)
Figure 4B:
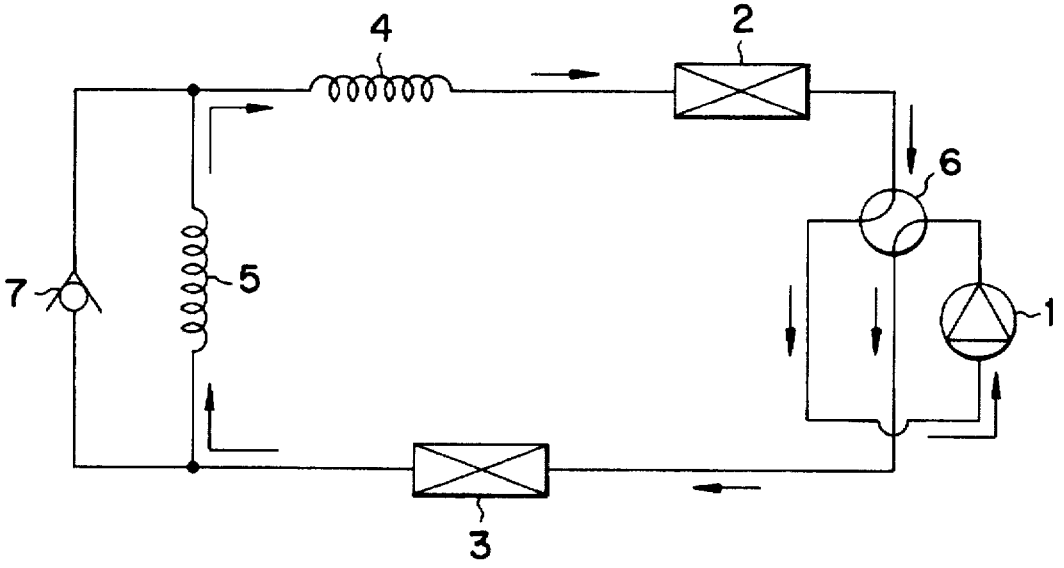
FIG. 4B (PRIOR ART)

Following the repetition of the above process, the indoor ambient temperature can rise beyond a prescribed point, causing the compressor to temporarily enter an idle state. FIG. 3B illustrates the operation during this event.

Once the compressor 1 enters a period of non-operation, the refrigerant pressure of the high pressure locality decreases, causing the movable partition 12 slide toward the second compartment 14 by elastic force. After the movable partition 12 passes the outlet of the first branch tube 22, the flow of the refrigerant through the first branch tube 22 is blocked. Accordingly, the refrigerant of the high pressure locality is isolated from that of a low pressure locality. At this time the movable partition 12 is disposed at a position within the refrigerant cut-off means 19 which is slightly off-center towards the first compartment 13.

This isolation of the high and low pressure localities allows the system to immediately re-enter the cooling cycle following the re-operation of the compressor 1.

The inventive refrigerant cut-off means which serves to separate the high pressure locality's refrigerant from the low pressure locality's refrigerant during the idle state of the compressor has been described in detail, and the present invention is not limited to the specific embodiment described in this specification. Therefore, the refrigerant cut-off means of the present invention may be applied to common cooling cycles, obtaining the same advantages.

The following description concerns the effect of the above-mentioned preferred embodiment.

When the heat pump heating and cooling system operates in the cooling cycle, refrigerant compressed by the compressor 1 passes through the outdoor heat exchanger 2, and is forced to enter the first compartment 13 via the first connecting tube 21. When the force on the movable partition 12 generated by the compressed refrigerant exceeds the combined elastic forces of the first and second elastic members, the movable partition 12 shifts toward the second compartment 14 from its original position.

After the movable partition 12 passes the outlet to the second branch tube 24, the refrigerant is forced into the indoor heat exchanger 3 through the second expansion tube 5. The refrigerant enters the compressor 1 and then follows the course of the aforementioned conventional cooling cycle.

When the indoor ambient temperature falls below a prescribed point during the cooling cycle, the compressor 1 enters an idle mode of operation and the refrigerant stops circulating. At this point, the refrigerant pressure of the high pressure locality (from the outlet of the compressor 1 to the outlet of the outdoor heat exchanger 2) is decreased to shift the movable partition 12 to the first compartment 13.

After the movable partition 12 passes the outlet of the second branch tube 24, the compressed refrigerant is prevented from flowing into the low pressure locality so that the high pressure locality's refrigerant is isolated from that of the low pressure locality.

The refrigerant is circulated in the opposite direction during the heating cycle.

More specifically, the refrigerant compressed by the compressor 1 changes its stream by the four-way valve 6 to pass through the indoor heat exchanger 3, and it enters the second compartment 14 by way of the second connecting tube 23. Once the force generated by the compressed refrigerant on the movable partition 12 exceeds the elastic forces of the first and second elastic members 15 and 16, the movable partition 12 shifts towards the first compartment 13.

After the movable partition 12 passes the outlet of the first branch tube 22, the refrigerant passes through the first expansion tube 4 and then enters the outdoor heat exchanger 2. The refrigerant is again introduced to the compressor 1 to be continuously circulated in the heating cycle.

In the event that the indoor ambient temperature rises over a prescribed point during the heating cycle, the compressor 1 enters an idle mode of operation and the refrigerant stops circulating. At this point, the refrigerant pressure of the high pressure locality (from the outlet of the compressor 1 to the outlet of the outdoor heat exchanger 2) is decreased to let the movable partition 12 shift towards the second compartment 14. Once the movable partition 12 passes the outlet of the first branch tube 22, the refrigerant is prevented from flowing to the low pressure locality. (from the inlet of the outdoor heat exchanger 2 to the inlet of the compressor 1).

As described above, the inventive heat pump heating and cooling system isolates the refrigerant of the high pressure locality from that of the low pressure locality when the compressor is in an idle mode of operation, and once the compressor goes into action again, the heat pump system is capable of implementing the room-cooling or room-heating function right away. Thus, the present invention may decrease the working hours of the compressor to ensure a reduction in power consumption and effective system operation as well.

Additionally, the present invention dispenses with the need for a check valve of a conventional art, and may be of simple and reliable design and construction.

What is claimed is:

1. A heat pump heating and cooling system for circulating refrigerant fluid, comprising:

a compressor having inlet and outlet sides;

an indoor heat exchanger connected to one of the sides of the compressor;

an outdoor heat exchanger connected to the other of the sides of the compressor;

first and second expansion devices connected between the indoor and outdoor heat exchangers;

a four-way valve for communicating the inlet and outlet sides of the compressor selectively with the indoor and outdoor heat exchangers, respectively; and a cut-off device interposed between the indoor and outdoor heat exchangers for fluidly communicating the indoor and outdoor heat exchangers with one another when the compressor is in an operating state, and automatically blocking fluid communication between the indoor and outdoor heat exchangers when the compressor is idle, thereby isolating high-pressure fluid from low-pressure fluid in the system.

2. The heat pump according to claim 1 wherein the cut-off device is operable in response to fluid pressure which overcomes a spring force in the cut-off device.

3. The heat pump according to claim 1 wherein the cut-off device comprises a housing, a movable partition in the housing dividing an interior of the housing into first and second compartments, and first and second springs disposed in the first and second compartments, respectively, for imposing oppositely directed forces on the partition.

4. The heat pump according to claim 3 wherein the cut-off device is disposed between the first and second expansion devices.

5. The heat pump according to claim 4 further comprising a first tube interconnecting the outdoor heat exchanger with the first compartment, a first branch tube branching from the first connecting tube and communicating with the first compartment, a second connecting tube interconnecting the indoor heat exchanger with the second compartment, a second branch tube branching from the second connecting tube and communicating with the second compartment, the two expansion devices being disposed in the first and second branch tubes, respectively, the partition being movable in response to fluid force between a first position communicating the first and second expansion devices with one another and a second position blocking fluid flow through the cut-off devices.

6. The heat pump according to claim 1 wherein the cut-off device is disposed between the first and second expansion devices.

* * * * *